US007267851B2

(12) United States Patent
Hsu et al.

(10) Patent No.: US 7,267,851 B2
(45) Date of Patent: Sep. 11, 2007

(54) ROTATING INFLATABLE ORNAMENT

(75) Inventors: Sheng-Hung Hsu, Kaohsiung (TW); Andrew G. Avinger, Coppell, TX (US)

(73) Assignee: Gemmy Industries Corporation, Coppell, TX (US)

( * ) Notice: Subject to any disclaimer, the term of this patent is extended or adjusted under 35 U.S.C. 154(b) by 0 days.

(21) Appl. No.: 11/230,494

(22) Filed: Sep. 21, 2005

(65) Prior Publication Data

US 2007/0062436 A1 Mar. 22, 2007

(51) Int. Cl.
*A63H 3/06* (2006.01)

(52) U.S. Cl. ..... 428/9; 428/12; 472/134; 446/220; 446/221; 446/223

(58) Field of Classification Search ..... 428/8, 428/9, 12; 5/713, 708; 40/412, 414; 472/134; 446/220–226

See application file for complete search history.

(56) References Cited

U.S. PATENT DOCUMENTS 7,108,608 B2 * 9/2006 Field et al. ..... 472/134
2005/0106990 A1 * 5/2005 Field et al. ..... 446/220

* cited by examiner

*Primary Examiner*—John J. Zimmerman
*Assistant Examiner*—Aaron Austin

(57) ABSTRACT

A rotating inflatable ornament has a main chamber, a bottom chamber, a rotating chamber, a rotating device, a joint tube and a blower. The bottom chamber is attached to a bottom of the main chamber. The rotating chamber is mounted in the main chamber and has a main air-entering tube, multiple jet tubes and multiple inflatable adornments. The main air-entering tube communicates with the bottom chamber. The rotating device is attached rotatably to the main chamber. The joint tube is attached to the main air-entering tube and is mounted rotatably in the bottom chamber. The blower is mounted in the bottom chamber and fills air into the bottom chamber. The air coming out of the jet tubes makes the rotating chamber rotate.

10 Claims, 8 Drawing Sheets

ROTATING INFLATABLE ORNAMENT

BACKGROUND OF THE INVENTION

1. Field of the Invention

The present invention relates to an inflatable ornament, especially to a rotating inflatable ornament.

2. Description of the Prior Art

Very large ornaments are often used in department stores, shopping malls and expositions as advertisement or to attract a crowd. To be stowed easily, the ornaments are often inflatable. When the inflatable ornaments are exhibited, the inflatable ornaments are inflated. When the inflatable ornaments are stowed, the inflatable ornaments are deflated. However, conventional inflatable ornaments are static. Therefore, the conventional inflatable ornaments do not create a lively or exciting atmosphere.

To overcome these shortcomings, the present invention provides a rotating inflatable ornament to mitigate or obviate the aforementioned problems.

SUMMARY OF THE INVENTION

The main objective of the present invention is to provide a rotating inflatable ornament to create excitement and a lively atmosphere. The rotating inflatable ornament has a main chamber, a bottom chamber, a rotating chamber, a rotating device, a joint tube and a blower. The main chamber has a top and a bottom. The bottom chamber is attached to the bottom of the main chamber. The rotating chamber is mounted in the main chamber and has a main air-entering tube, multiple jet tubes and multiple inflatable adornments. The main air-entering tube communicates with the bottom chamber. The rotating device is attached respectively to the main chamber and the rotating chamber and is rotatable. The joint tube is attached to the main air-entering tube and is mounted rotatably in the bottom chamber. The blower is mounted in the bottom chamber and fills air into the bottom chamber. The air coming out of the jet tubes makes the rotating chamber rotate.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
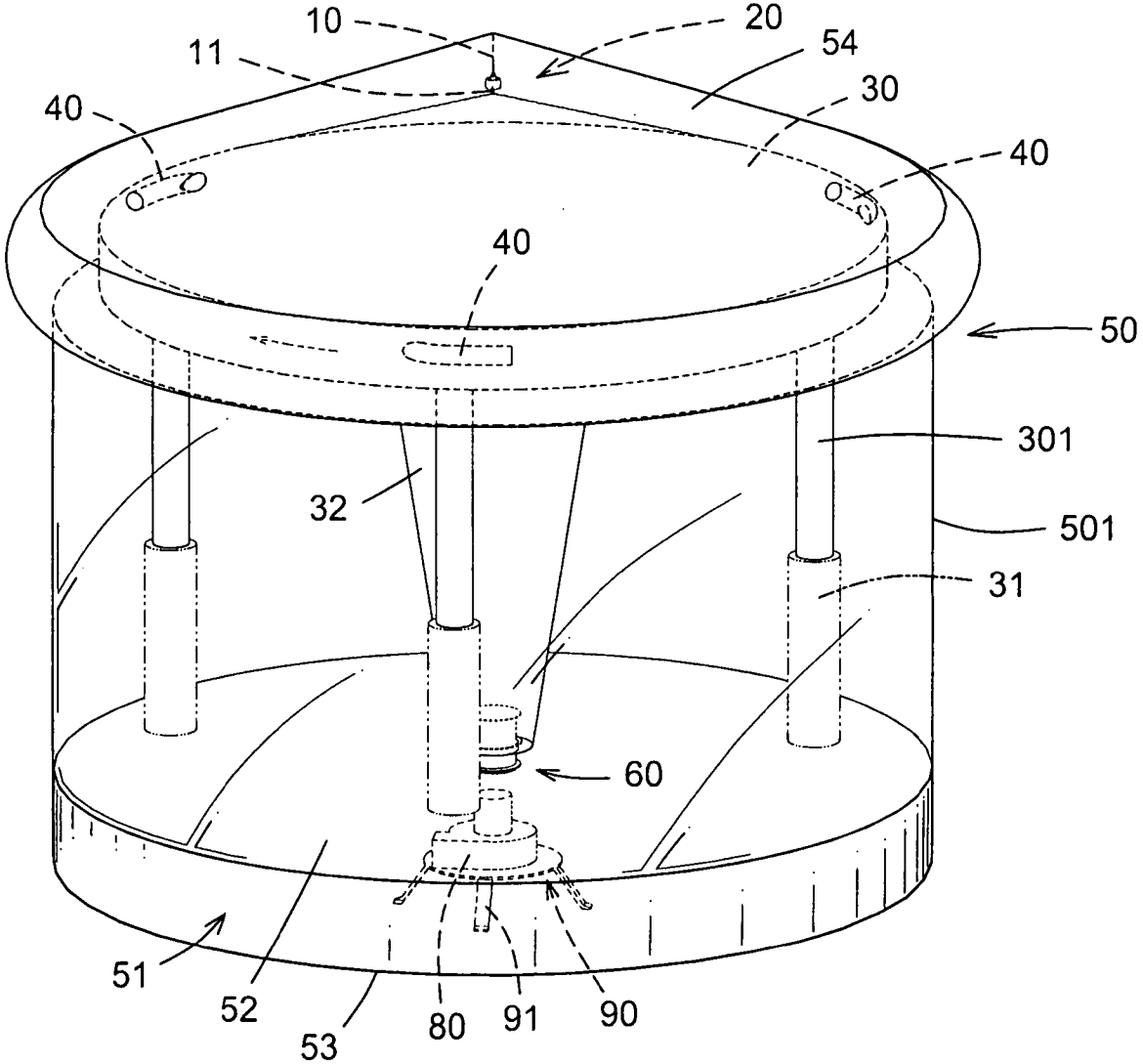
FIG. 1 is a perspective view of a rotating inflatable ornament in accordance with the present invention.
Figure 2:
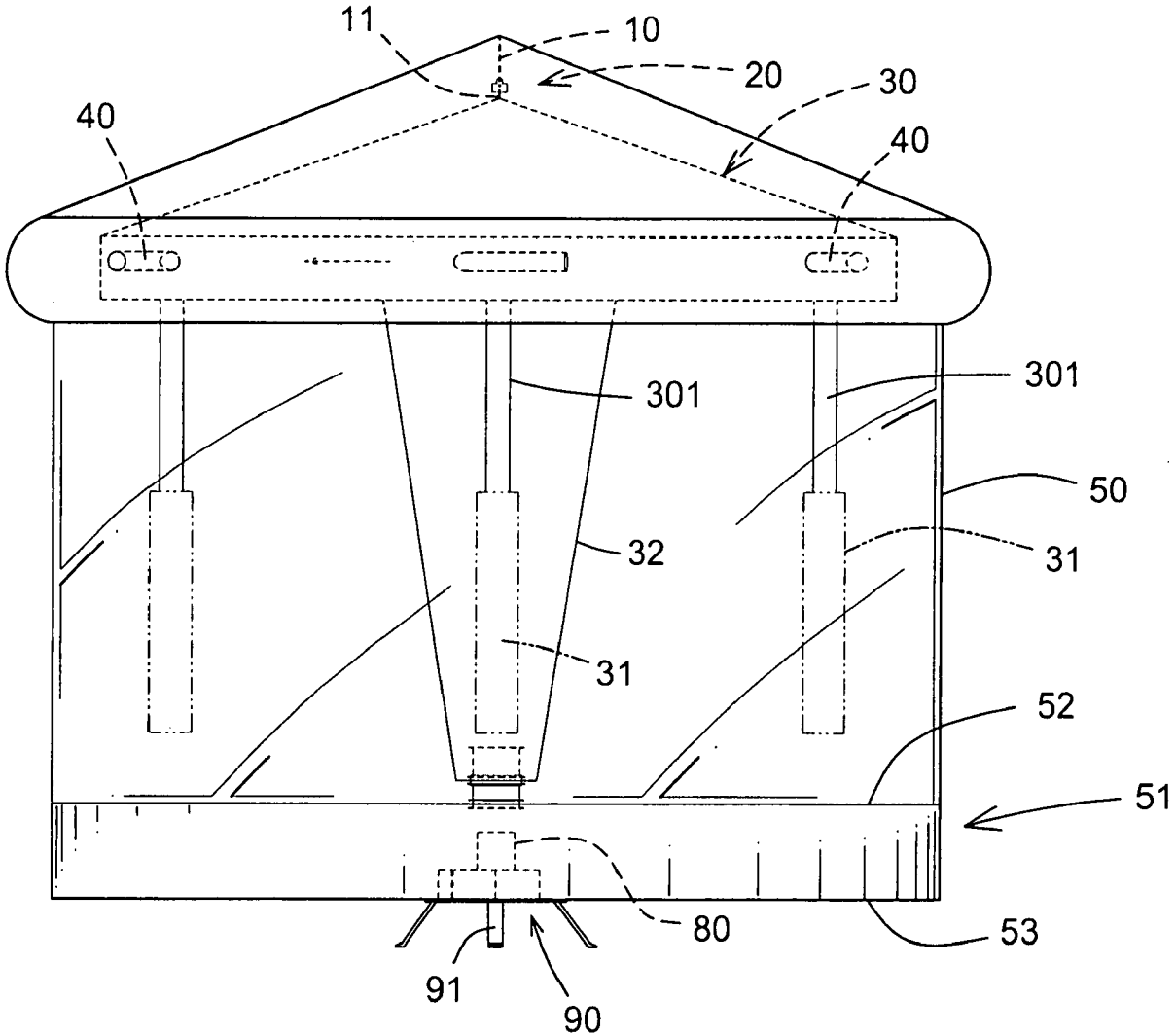
FIG. 2 is side view of the rotating inflatable ornament in FIG. 1.
Figure 8:
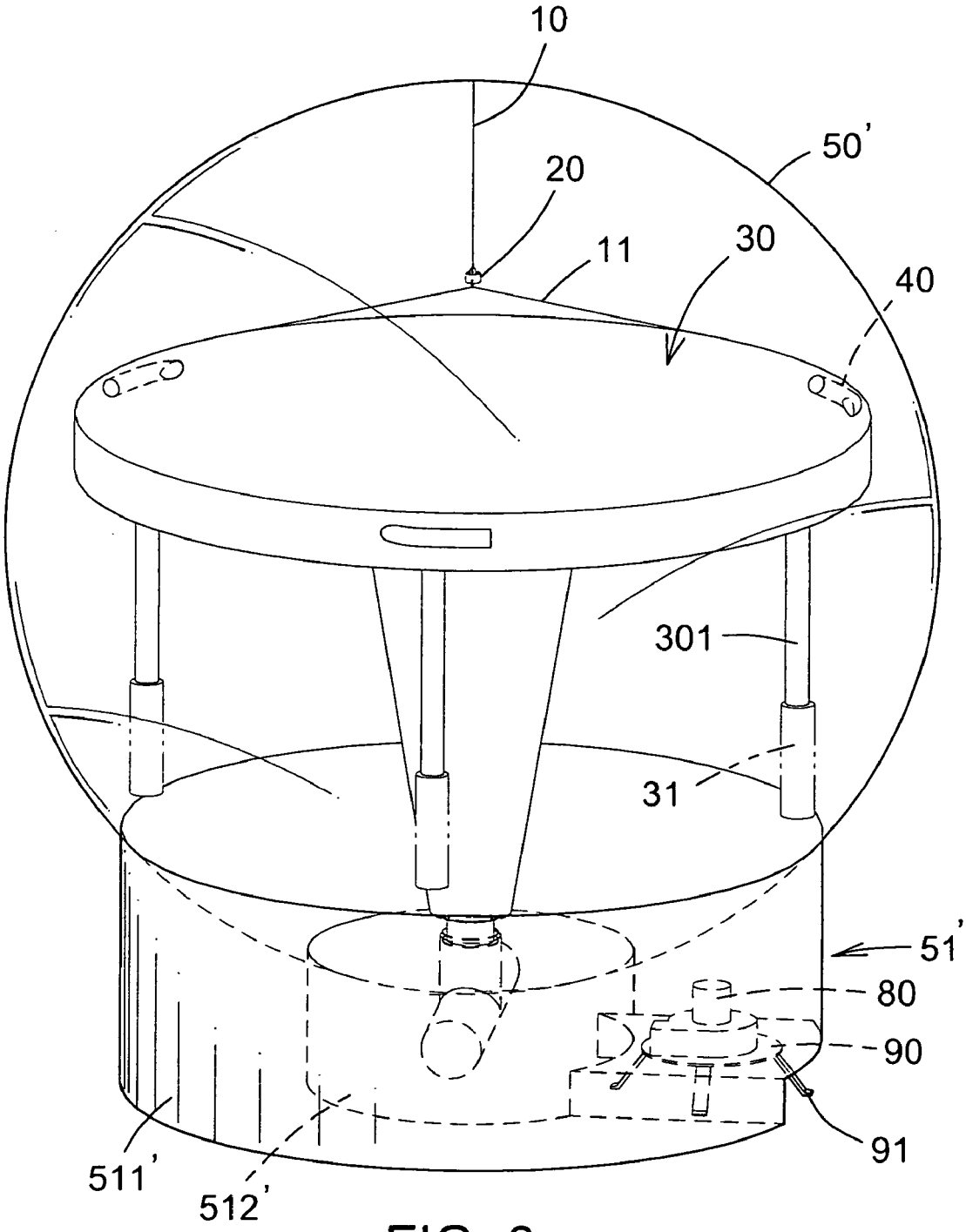
FIG. 8 is a side view of another embodiment of a rotating inflatable ornament in accordance with the present invention.

With reference to FIGS. 1, 2 and 8, a rotating inflatable ornament in accordance with the present invention comprises a main chamber (50, 50'), a bottom chamber (51), a base (90), a blower (80), a rotating device (20), a joint tube (60) and a rotating chamber (30).

With reference to FIGS. 1 and 2, the main chamber (50) is hollow and transparent, has a top, a bottom, an inside surface and a stationary cord (10) and may have a body (501) and a top chamber (54). The body (501) of the main chamber (50) has a top and a bottom. The top chamber (54) is attached to the top of the body (501) of the main chamber (50), communicates with the body (501) of the main chamber (50) and has an inside surface. The stationary cord (10) may be attached to the inside surface of the top chamber (54).

The bottom chamber (51) is hollow and is attached to the bottom of the body (501) of the main chamber (50). The bottom chamber (51) communicates with the body (501) of the main chamber (50). The bottom chamber (51) has a top (52) and a bottom (53). The top (52) is attached to and corresponds to the bottom of the body (501) of the main chamber (50).

The base (90) is attached to the bottom (53) of the bottom chamber (51) and has a support (91) to stand on the ground.

The blower (80) is mounted in the bottom chamber (51) and corresponds to the base (90) and may be mounted in the outer chamber (511') of the bottom chamber (51').

Figure 3:
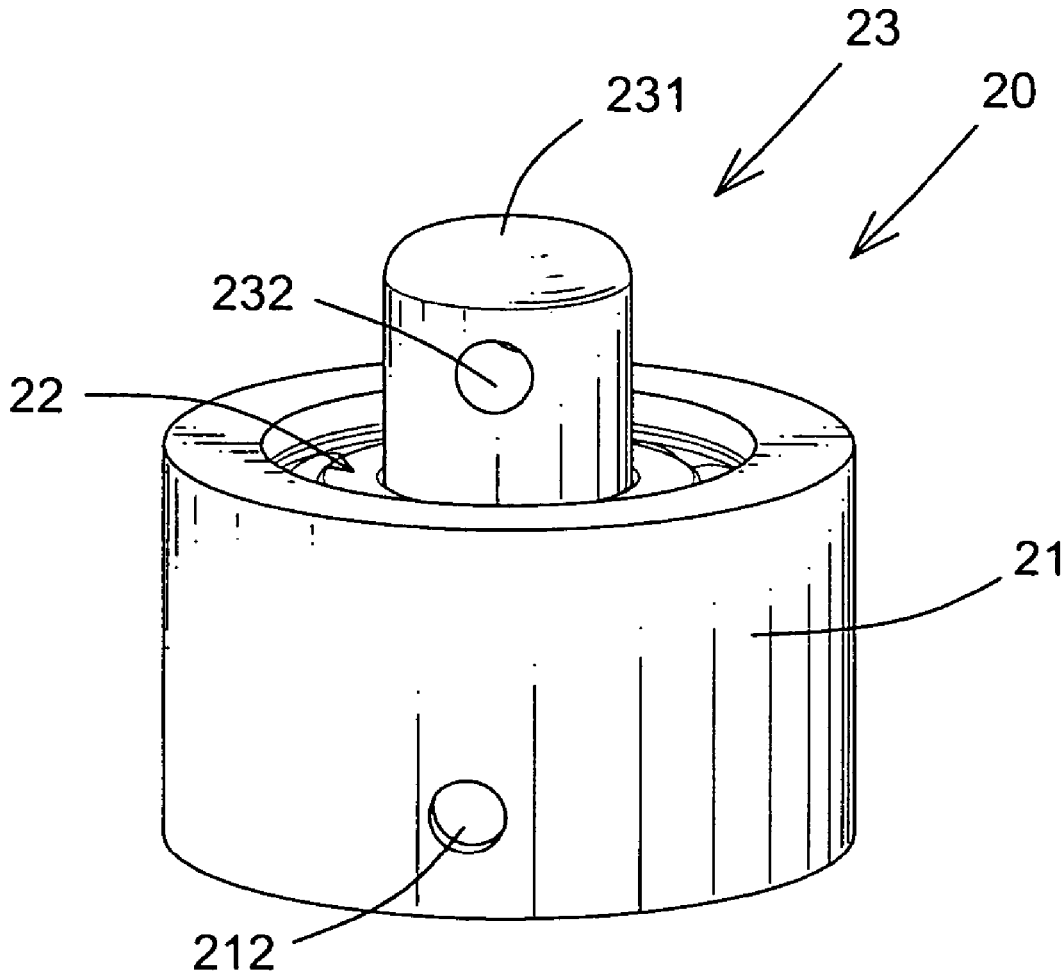
FIG. 3 is a perspective view of a rotating device of the rotating inflatable ornament in FIG. 1.
Figure 4:
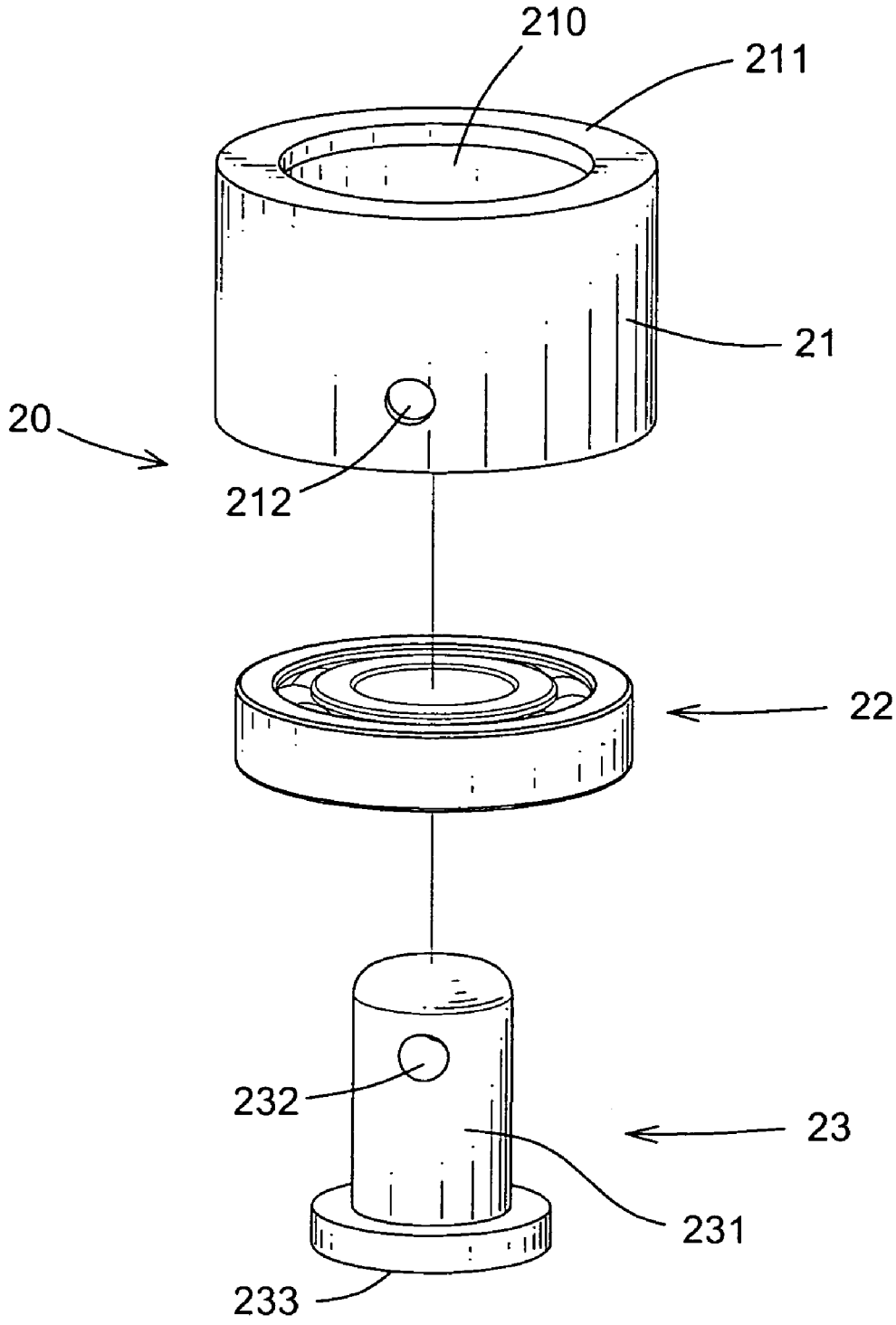
FIG. 4 is an exploded perspective view of the rotating device in FIG. 3.
Figure 5:
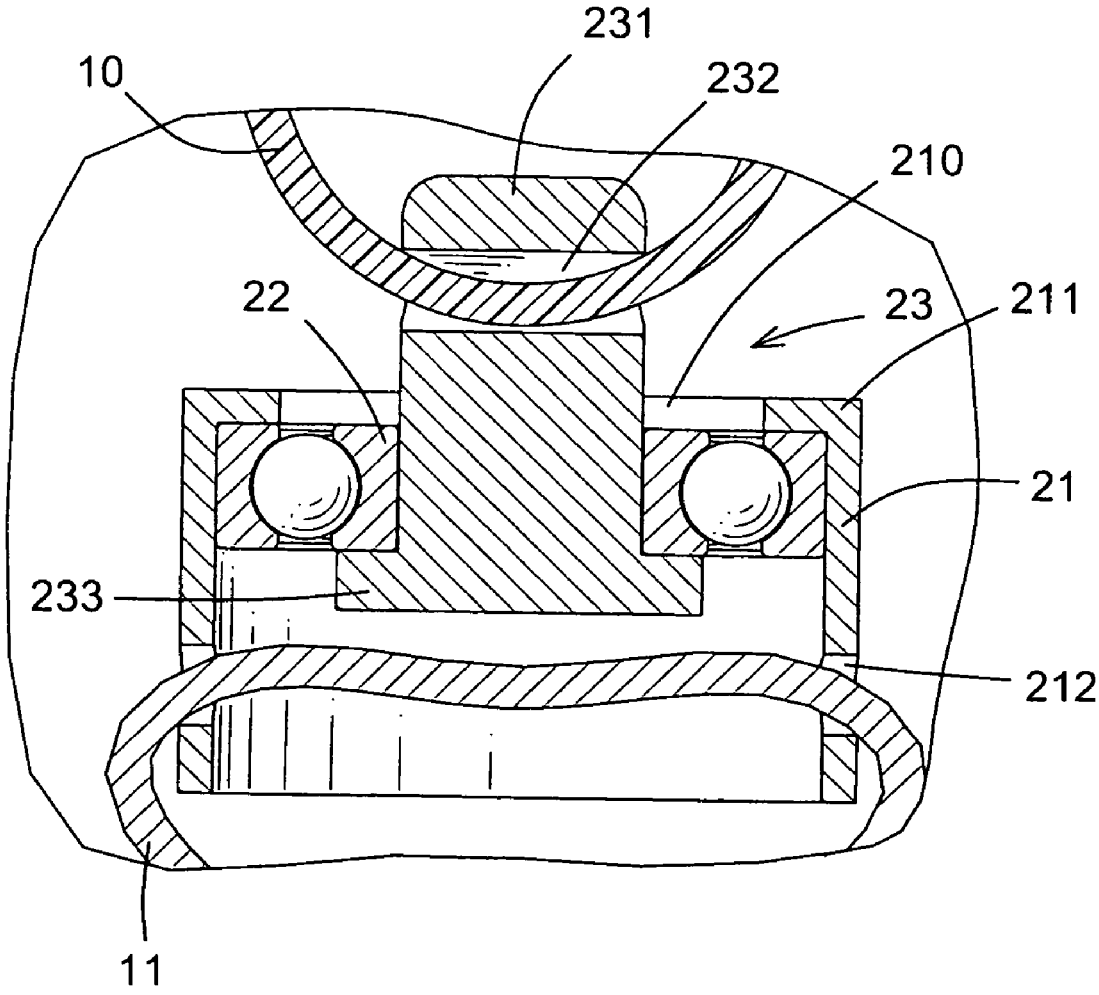
FIG. 5 is a partial side view in cross section of the rotating inflatable ornament in FIG. 1.

With further reference to FIGS. 3-5, the rotating device (20) is attached to the stationary rope (10), is rotatable and may have a sleeve (21), a shaft (23), a bearing (22) and a rotating rope (11).

The sleeve (21) is hollow and has a top opening (210), a sidewall, an upper annular flange (211) and a pair of through holes (212). The upper annular flange (211) is formed on the sidewall inside the sleeve (21). The pair of through holes (212) are formed opposite to each other through the sidewall of the sleeve (21).

The shaft (23) is mounted in the sleeve (21), protrudes out from the top opening (210) of the sleeve (21) and has a body (231), a through hole (232) and a lower annular flange (233). The body (231) has an upper end and a lower end. The through hole (232) is formed through the body (231) near the upper end, and is passed through by the stationary rope (10). The lower annular flange (233) is formed on the lower end of the body (231).

The bearing (22) is mounted in the sleeve (21) and is clamped between the annular flanges (211, 233) of the sleeve (21) and the shaft (23). The rotating rope (11) passes through the pair of through holes (212) of the sleeve (21).

Figure 6:
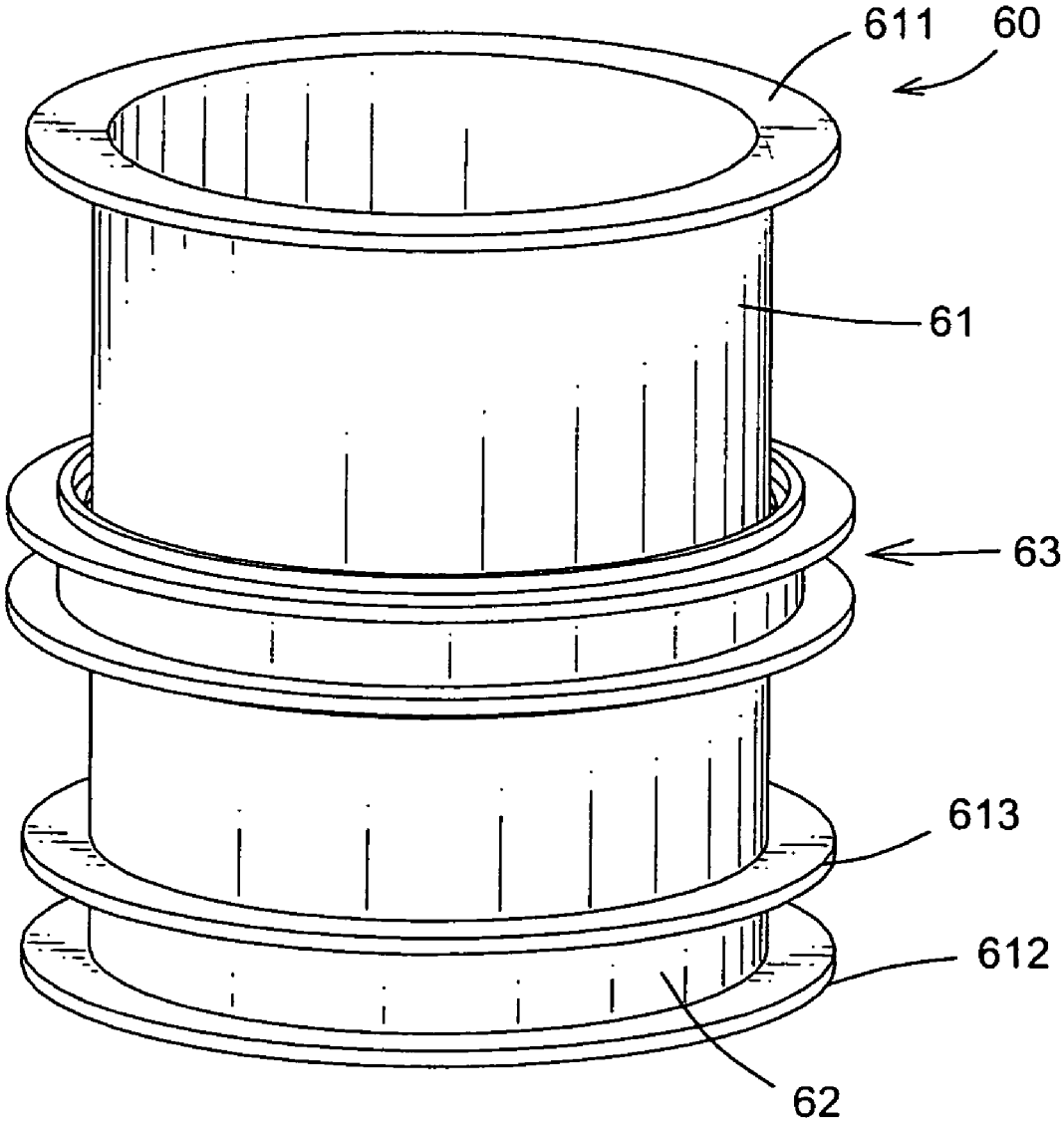
FIG. 6 is a perspective view of a joint tube of the rotating inflatable ornament in FIG. 1.
Figure 7:
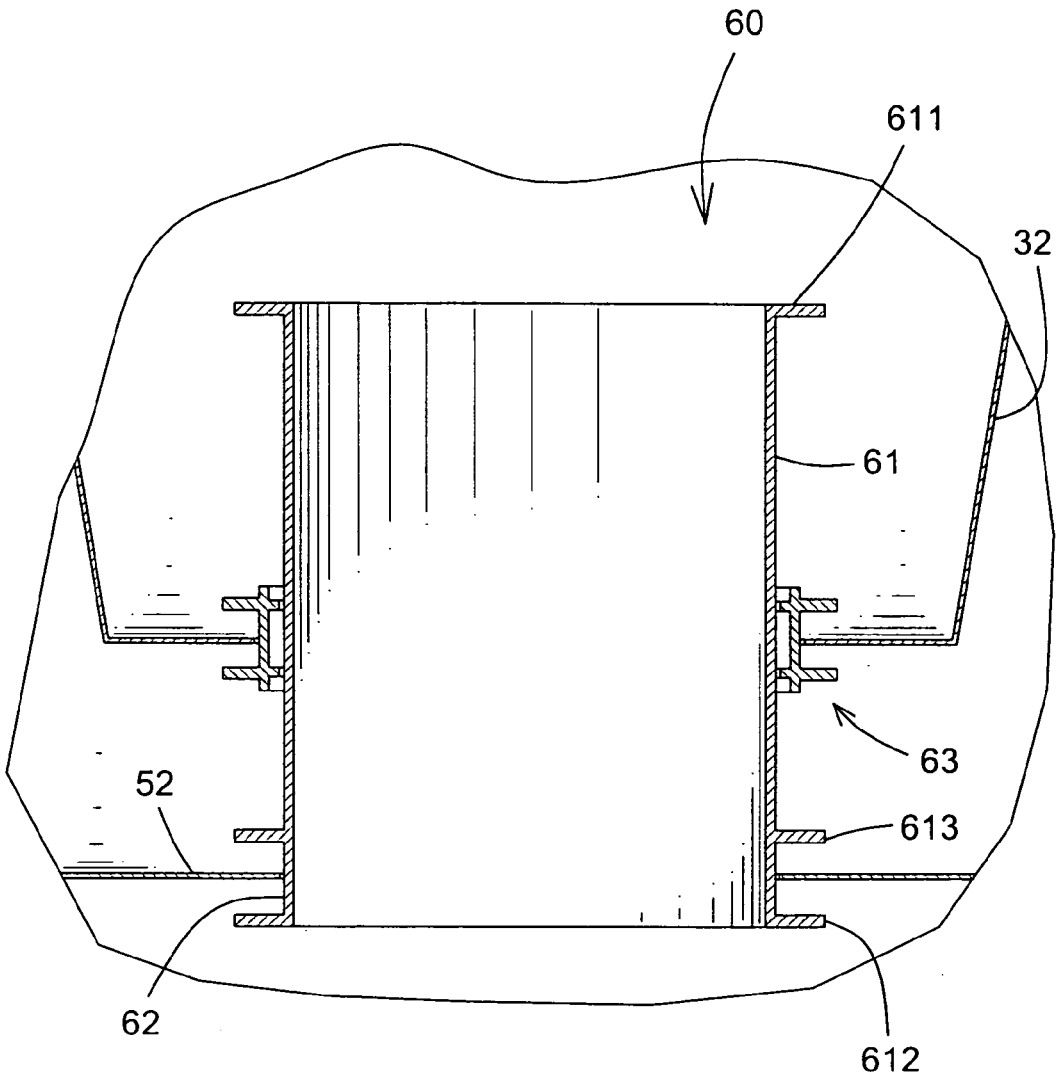
FIG. 7 is a partial side view in cross section of the rotating inflatable ornament in FIG. 1.

With further reference to FIGS. 6 and 7, the joint tube (60) is attached to the top (52) of the bottom chamber (51), communicates with the bottom chamber (51) and may have a body (61). The body (61) has a top end, a bottom end, a first flange (611), a second flange (612), a third flange (613) and an annular recess (62). The bottom end of the body (61) extends into the top (52) of the bottom chamber (51). The first flange (611) is formed around and protrudes radially Out of the top end of the body (61) of the joint tube (60). The second flange (612) is formed around and protrudes radially out of the bottom end of the body (61) of the joint tube (60). The third flange (613) is formed around the body (61) of the joint tube (60) near the second flange (612). The annular recess (62) is formed between the second and third flanges (612, 613) of the body (61) of the joint tube (60). The top (52) of the bottom chamber (51) is mounted in the annular recess (613).

The rotating chamber (30) may be mounted in the top chamber (54) and may extend into the body (501) of the main chamber (50). The rotating chamber (30) has a body, a main air-entering tube (32), multiple jet tubes (40), multiple inflatable adornments (31) and multiple optional minor air-entering tubes (301). The body of the rotating chamber (30) is attached to the rotating device (20), may be attached to the rotating rope (11) and has a bottom and a sidewall. The main air-entering tube (32) is formed at the bottom of the body of the rotating chamber (30) and may extend into the body (501) of the main chamber (50). The main air-entering tube (32) communicates with the body (61) of the joint tube (60) and the body of the rotating chamber (30) and has an optional ring (63) and a distal end. The ring (63) is mounted rotatably around the body (61) of the joint tube (60). The distal end of the main air-entering tube (32) is mounted rotatably around the joint tube (60) and may be mounted securely on the ring (63). The jet tubes (40) are formed separately in and extend out of the sidewall of the body of the rotating chamber (30) and may communicate with the body of the rotating chamber (30) and the top chamber (54). The jet tubes (40) may extend radially, in a preferred embodiment, in tangent directions, out of the sidewall of the body of the rotating chamber (30). The inflatable adornments (31) are mounted on the bottom of the body of the rotating chamber (30), communicate with the body of the rotating chamber (30) and may extend into the body (501) of the main chamber (50). The minor air-entering tubes (301) are mounted respectively between the inflatable adornments (31) and the bottom of the body of the rotating chamber (30) and communicate with the inflatable adornments (31) and the body of the rotating chamber (30).

With reference to FIGS. 1 and 2, the blower (80) pumps air into the main air-entering tube (32) through the joint tube (60). The body of the rotating chamber (30) is filled with air. The air flows into the top chamber (54) through the jet tubes (40) and fills the top chamber (54) and the main chamber (10). The air coming out of the jet tubes (40) makes the rotating chamber (30) rotate. With further reference to FIG. 5, the sleeve (21) rotates around the shaft (23). With further reference to FIG. 7, the ring (63) rotates around the body (61) of the joint tube (60). Then the inflatable adornments (31) are rotated with the rotating chamber (30) to give a lively impression.

The second embodiment in accordance with the present invention is shown in FIGS. 7 and 8. The main chamber (50') is spherical. The stationary cord (10) is attached to the inside surface of the main chamber (50'). The bottom chamber (51') is hollow, is attached to the bottom of the main chamber (50'), communicates with the main chamber (50') and may have an outer chamber (511') and an inner chamber (512'). The top (52') of the-bottom chamber (51') is attached to and corresponds to the bottom of the main chamber (50'). The inner chamber (512') of the bottom chamber (51') communicates with the outer chamber (511') of the bottom chamber (51'). The blower (80) is mounted in the outer chamber (511') of the bottom chamber (51'). The rotating chamber (30) is mounted rotatably in the main chamber (50'). The jet tubes (40) communicate the body of the rotating chamber (30) with the main chamber (50').

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A rotating inflatable ornament comprising:

a main chamber being hollow and transparent and having
- a top;
- a bottom;
- an inside surface; and
- a stationary cord attached inside the main chamber;

a bottom chamber attached to the bottom of the main chamber, being hollow, communicating with the main chamber and having
- a top attached to and corresponding to the bottom of the main chamber; and
- a bottom;

a base attached to the bottom of the bottom chamber and having a support;

a blower mounted in the bottom chamber and corresponding to the base;

a rotating device attached to the stationary cord and being rotatable;

a joint tube attached to the top of the bottom chamber and communicating with the bottom chamber; and a rotating chamber mounted rotatably in the main chamber and having a body attached to the rotating device and having a bottom and a sidewall;
- a main air-entering tube formed at the bottom of the body of the rotating chamber, communicating with the body of the joint tube and the body of the rotating chamber, and the main air-entering tube having a distal end mounted rotatably around the joint tube;
- multiple jet tubes formed separately in and extending out of the sidewall of the body of the rotating chamber and communicating with the body of the rotating chamber and the main chamber; and
- multiple inflatable adornments mounted on the bottom of the body of the rotating chamber and communicating with the body of the rotating chamber.

2. The rotating inflatable ornament as claimed in claim 1, wherein the main chamber is spherical;
- the bottom chamber has
  - an outer chamber; and
  - an inner chamber communicating with the outer chamber of the bottom chamber; and the blower is mounted in the outer chamber of the bottom chamber.

3. The rotating inflatable ornament as claimed in claim 1, wherein the main chamber has
- a body having a top and a bottom; and
- a top chamber attached to the top of the body of the main chamber, communicating with the body of the main chamber and having an inside surface;

the stationary cord is attached to the inside surface of the top chamber;

the bottom chamber is attached to the bottom of the body of the main chamber and communicates with the body of the main chamber;

the top of the bottom chamber is attached to and corresponds to the bottom of the body of the main chamber;

the rotating chamber is mounted in the top chamber and extends into the body of the main chamber;

the main air-entering tube extends into the body of the main chamber;

the jet tubes communicate with the top chamber of the main chamber; and the inflatable adornments extend into the body of the main chamber.

4. The rotating inflatable ornament as claimed in claim 3, wherein the rotating device has a sleeve being hollow and having a top opening;

a sidewall;

an upper annular flange formed on the sidewall in the sleeve; and a pair of through holes formed opposite to each other through the sidewall of the sleeve;

a shaft mounted in the sleeve, protruding out from the top opening of the sleeve and having a body having an upper end and a lower end;

a through hole formed through the body near the upper end and passed through by the stationary cord; and a lower annular flange formed on the lower end of the body;

a bearing mounted in the sleeve and clamped between the annular flanges of the sleeve and the shaft; and a rotating cord extending through the pair of through holes of the sleeve and attached to the body of the rotating chamber.

5. The rotating inflatable ornament as claimed in claim 3, wherein the joint tube has a body having a top end;

a bottom end extending into the top of the bottom chamber;

a first flange formed around and protruding radially out of the top end of the body of the joint tube;

a second flange formed around and protruding radially out of the bottom end of the body of the joint tube;

a third flange formed around the body of the joint tube near the second flange; and an annular recess formed between the second and third flanges of the body of the joint tube wherein the top of the bottom chamber is mounted in the annular recess;

the main air-entering tube has a ring mounted rotatably around the body of the joint tube; and the distal end of the main air-entering tube is mounted securely on the ring.

6. The rotating inflatable ornament as claimed in claim 4, wherein the joint tube has a body having a top end;

a bottom end extending into the top of the bottom chamber;

a first flange formed around and protruding radially out of the top end of the body of the joint tube;

a second flange formed around and protruding radially out of the bottom end of the body of the joint tube;

a third flange formed around the body of the joint tube near the second flange; and an annular recess formed between the second and third flanges of the body of the joint tube wherein the top of the bottom chamber is mounted in the annular recess;

the main air-entering tube has a ring mounted rotatably around the body of the joint tube; and the distal end of the main air-entering tube is mounted securely on the ring.

7. The rotating inflatable ornament as claimed in claim 3, wherein the rotating chamber has multiple minor air-entering tubes mounted respectively between the inflatable adornments and the bottom of the body of the rotating chamber and communicating with the inflatable adornments and the body of the rotating chamber.

8. The rotating inflatable ornament as claimed in claim 6, wherein the rotating chamber has multiple minor air-entering tubes mounted respectively between the inflatable adornments and the bottom of the body of the rotating chamber and communicating with the inflatable adornments and the body of the rotating chamber.

9. The rotating inflatable ornament as claimed in claim 1, wherein the jet tubes extend radially out of the body of the rotating chamber.

10. The rotating inflatable ornament as claimed in claim 8, wherein the jet tubes extend radially out of the body of the rotating chamber.

* * * * *